US005851320A

United States Patent [19]

Auran et al.

[11] Patent Number: 5,851,320

[45] Date of Patent: Dec. 22, 1998

[54] WEAR-RESISTANT ALUMINUM ALLOY AND COMPRESSOR PISTON FORMED THEREFROM

[75] Inventors: Lars Auran, Sundalsora, Norway; Gary Hugh Rhinehart, Blissfield, Mich.; Saumin Shantilal Mehta, Toledo, Ohio

[73] Assignee: Norsk Hydro, A. S., Oslo, Norway

[21] Appl. No.: 583,228

[22] Filed: Jan. 5, 1996

[51] Int. Cl.[6] ..... C22C 21/00

[52] U.S. Cl. ..... 148/552; 148/417; 148/418; 148/439; 420/532; 420/534; 420/535

[58] Field of Search ..... ; 148/417, 418, 148/439; 420/532, 534, 535; C22C 21/02, 21/04

[56] References Cited

FOREIGN PATENT DOCUMENTS

| | | | |
|---|---|---|---|
| 0 141 501 | 5/1985 | European Pat. Off. | C22C 21/02 |
| 62-001839 | 1/1987 | Japan | C22C 21/02 |
| 2213442 | 8/1989 | Japan | C22C 21/02 |
| 1298131 | 12/1989 | Japan | C22C 21/02 |
| 7197164 | 8/1995 | Japan | C22C 21/02 |
| 7197165 | 8/1995 | Japan | C22C 21/02 |

OTHER PUBLICATIONS

Translation of JP (07–197165).

*Primary Examiner*—Patrick Ryan
*Assistant Examiner*—M. Alexandra Elve
*Attorney, Agent, or Firm*—Gary M. Hartman; Domenica N. S. Hartman

[57] ABSTRACT

An improved aluminum alloy containing specific additions of silicon and copper to improve wear resistance and improve solutionizing of the alloying constituents, and a process for forming a wear-resistant component from the alloy. The improved aluminum alloy is also characterized by good strength and sufficient ductility so as to permit forging of a wear-resistant component from the alloy. A preferred composition for the alloy, in weight percent, is about 13.0 to about 15.5 percent silicon; about 0.8 to about 2.0 percent copper; about 0.8 to about 1.3 percent magnesium, and the balance being aluminum and impurities. The aluminum alloy is particularly well suited to form pistons of the type used in compressors of automotive air conditioning systems.

13 Claims, 1 Drawing Sheet

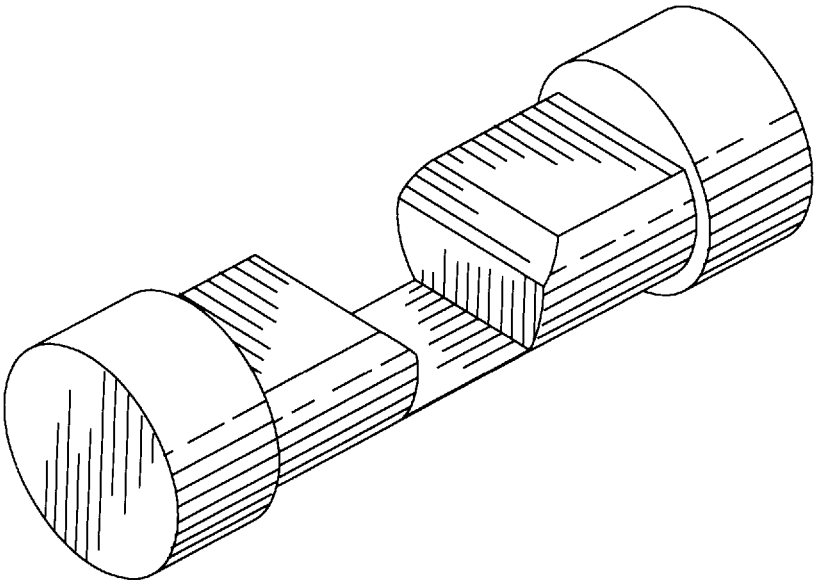

WEAR-RESISTANT ALUMINUM ALLOY AND COMPRESSOR PISTON FORMED THEREFROM

BACKGROUND OF THE INVENTION

1. Field of the Invention

The present invention generally relates to aluminum alloys of the type used to form forged compressor pistons of automotive air conditioning systems. More particularly, this invention relates to an aluminum alloy that is processed and alloyed to contain specific additions of silicon and copper to reliably produce a more wear-resistant piston.

2. Description of the Prior Art

Air conditioning systems are employed within automobiles and other vehicles for creating comfortable conditions within the passenger compartment for the vehicle occupants. Automobiles generally require the use of an engine-driven compressor to compress the refrigerant used in the cooling cycle. The materials and components within the air conditioning system, and particularly those materials used to form the components of the compressor, must be capable of withstanding extremely demanding conditions. The compressor utilizes pistons that continuously wear against mating surfaces during operation of the air conditioning system, while also being subject to significant pressures due to the compressed refrigerant. The result is that during operation of the air conditioning system, the surfaces of the pistons are highly susceptible to wear.

Therefore, it is necessary to form air conditioner compressor pistons from a wear resistant material. However, it is also necessary that the pistons be light weight and readily manufactured. Forged aluminum alloy pistons offer the advantage of a strong, relatively low-weight piston design in combination with a reliable high-volume manufacturing process. Aluminum-silicon alloys containing up to about twelve percent silicon, such as AA 4032, are used in the industry to form forged engine pistons due to their low coefficient of thermal expansion and high wear resistance. However, the propensity for wear has been found to be particularly acute with pistons forged from aluminum-silicon alloys when employed in certain compressor designs, such as those that employ a swash plate that defines the stroke of the pistons. In these compressors, the high friction between the swash plate and pistons at high speeds can result in extreme wear of the pistons.

Accordingly, it would be desirable if an aluminum alloy were available whose mechanical and wear properties were well suited for the demanding service environment of a compressor piston, yet could be readily processed and formed by forging methods.

SUMMARY OF THE INVENTION

It is an object of this invention to provide a wear-resistant aluminum alloy particularly suitable for use as a piston in a compressor of an automobile air conditioning system.

It is a further object of this invention that such an aluminum alloy is sufficiently ductile so as to permit the piston to be formed by forging, yet also exhibits sufficient strength to enable the piston to reliably perform within a compressor.

It is another object of this invention that such an aluminum alloy can be readily processed to appropriately solutionize its alloying constituents and thereby acquire desirable mechanical and wear properties.

In accordance with a preferred embodiment of this invention, these and other objects and advantages are accomplished as follows.

According to the present invention, there is provided an improved aluminum alloy that is alloyed to contain specific additions of silicon and copper to improve wear resistance and improve solutionizing of the alloying constituents, and a process for forming a wear-resistant component from the alloy. In addition, the improved aluminum alloy of this invention is also characterized by good strength and sufficient ductility so as to permit forging of a wear-resistant component from the alloy. The aluminum alloy is particularly well suited to form pistons of the type used in compressors of automotive air conditioning systems, though the alloy could be used to form a wide variety of components, particularly forged components that require high strength and wear resistance in their service environments.

The preferred wear-resistant aluminum alloy of this invention is characterized by the following elemental composition, in weight percent: about 13.0 to about 15.5 percent silicon; about 0.8 to about 2.0 percent copper; and about 0.8 to about 1.3 percent magnesium; the balance being aluminum and impurities. In a more preferred embodiment, the wear-resistant aluminum alloy contains about 14.75 to about 15.25 percent silicon, about 1.3 to about 1.8 weight percent copper, and not more than 0.15 percent nickel. In addition, the aluminum alloy may contain not more than 0.7 percent iron, not more than 0.25 percent zinc, not more than 0.2 percent manganese, not more than 0.1 percent chromium, not more than 0.1 percent titanium, and not more than 0.15 percent impurities, of which none individually exceeds 0.05 percent of the alloy.

A particularly advantageous feature of the aluminum alloy of this invention is that the relatively high level of silicon yields hard primary silicon particles that enhance the wear resistance of the alloy. Because silicon also increases the brittleness of an aluminum alloy, thereby reducing its effective strength, the size of the silicon particles is carefully controlled. Such high levels of silicon were also found to cause blistering during solutionizing of the alloy. As a solution, the present invention further entails a novel process in which a reduced solutionizing temperature and duration are employed to eliminate blistering. Finally, the relatively high copper level serves to achieve appropriate solutionizing of the alloying constituents at the reduced solution heat treatment temperature. Advantageously, the higher copper level also yields more $Cu_2Al$ (copper-aluminide) hardening phase, thereby further promoting the strength of the alloy and partially compensating for embrittlement promoted by the high silicon content of the alloy.

According to this invention, the aluminum alloy is sufficiently ductile to readily permit forging of components from the alloy, while exhibiting sufficient strength to permit such components to serve in physically demanding applications, such as the piston of an air conditioning compressor. Due to the unique chemical composition of the wear-resistant aluminum alloy of this invention, processing of the alloy to form a forged component generally entails the steps of casting a homogeneous melt of the alloy, forging the alloy to form the component, and then solution treating the component at a relatively low temperature of about 480° C. for a duration of only about two hours, during which a solid solution of copper-aluminide is formed. Aging can then be performed to stabilize the desired mechanical properties of the alloy. In this manner, it can be seen that the wear-resistant alloy of this invention can be readily processed to form a high-strength, wear-resistant component.

Other objects and advantages of this invention will be better appreciated from the following detailed description.

BRIEF DESCRIPTION OF THE DRAWINGS

The above and other advantages of this invention will become more apparent from the following description taken in conjunction with the accompanying Figure, which shows in perspective a compressor piston for an automotive air conditioning unit.

DETAILED DESCRIPTION OF THE PREFERRED EMBODIMENT

The present invention provides an improved aluminum alloy that is alloyed to contain relatively high levels of silicon and copper to improve wear resistance and improve solutionizing of the alloying constituents, respectively, and a process for forming a wear-resistant component from such an alloy. Advantageously, the improved aluminum alloy of this invention is also characterized by good strength and sufficient ductility so as to enable a wear-resistant component to be readily forged from the alloy. The aluminum alloy is particularly well suited for forming pistons of the type used in compressors of automotive air conditioning systems, an example of which is shown in the Figure. However, those skilled in the art will appreciate that the aluminum alloy of this invention could be used to form a wide variety of components, and particularly forged components that require high strength and wear resistance in their service environments.

The particular piston shown in the Figure is a dual-sided piston for use in a five-cylinder compressor of an automotive air conditioning unit, in which a swash plate (not shown) serves to define the stroke of the piston. At high speeds, considerable friction exists between the swash plate and the piston, leading to high wear rates unless the piston is formed from an appropriate wear-resistant material. In the prior art, pistons for compressors have been formed from aluminum-silicon alloys such as AA 4032, which has a composition of, in weight percent, 11.0 to 13.5 percent silicon; 0.5 to 1.3 percent copper; 0.8 to 1.3 percent magnesium; 0.5 to 1.3 percent nickel, with the balance being aluminum and not more than 1.0 percent iron, not more than 0.25 percent zinc, not more than 0.1 percent chromium, and not more than 0.15 percent impurities, of which none individually exceeds 0.05 percent of the alloy. While pistons formed from this material have performed quite satisfactorily in a wide variety of applications, compressor pistons of the type represented in the Figure exhibit excessive wear if forged from the AA 4032 alloy.

In contrast, the piston shown in the Figure is characterized by ample wear resistance and strength when forged from the wear-resistant aluminum alloy of this invention. The alloy has the following base, preferred and most preferred elemental composition, in weight percent:

TABLE I

| | BASE | PREFERRED | MOST PREFERRED |
|---|---|---|---|
| Silicon | 13.0 to 15.5 | 14.75 to 15.25 | 15 |
| Copper | 0.8 to 2.0 | 1.3 to 1.8 | 1.5 |
| Magnesium | 0.8 to 1.3 | 0.9 to 1.2 | 1.0 |
| Aluminum | Balance | Balance | Balance |

In addition to the above, the aluminum alloy of this invention may contain not more than 0.7 percent iron, not more than 0.25 percent zinc, not more than 0.2 percent manganese, not more than 0.15 percent nickel, not more than 0.1 percent chromium, not more than 0.1 percent titanium, and not more than 0.15 percent impurities, of which none individually exceeds 0.05 percent of the alloy. Notably, the silicon and copper content of this alloy is significantly higher than that of the AA 4032 alloy, while nickel, if present at all, is reduced to a level significantly lower than that of the AA 4032 alloy.

According to this invention, the relatively high level of silicon in the alloy enhances the wear resistance of components formed from the alloy by forming hard primary silicon particles. Notably, the silicon content of the aluminum alloy is above the eutectic point in the aluminum-silicon phase diagram (about 12.3 percent silicon), making the preferred alloy a hyper-eutectic aluminum-silicon alloy. Maintaining the silicon level above the eutectic point ensures that hard primary silicon particles will form within the alloy. The level and size distribution of the silicon particles in the alloy is critical to achieve optimum performance of the piston shown in the Figure. Silicon increases the brittleness of an aluminum alloy, thereby reducing its effective strength. As a solution, the present invention preferably entails controlling the size of the silicon particles within a range of about fifteen to thirty-five micrometers in equivalent diameter. A preferred technique for achieving this control is to treat the alloy with very small amounts of phosphorus during melt treatment, generally up to the 0.015 weight percent limit noted above for impurities in the alloy. Phosphorus can be added to the alloy by conventional phosphorus treatment methods, which include adding a phosphorus-containing compound to the melt during casting.

If not offset, the high level of silicon in the alloy of this invention also promotes blistering of the piston during solutionizing after forging. As is conventional with the AA 4032 alloy, a solution heat treatment is performed after forging in order to allow one or more of the alloying constituents to enter into solid solution, after which the alloy is cooled rapidly to hold the constituents in solution. The alloy is then in a supersaturated, unstable state, which is later aged to stabilize the mechanical properties of the alloy. Two causes of the blister defect are that a higher silicon content increases the alloy's melt temperature, which promotes the dissolution of hydrogen into the alloy, and makes the alloy more difficult to forge, resulting in micro-cracks and sites through which hydrogen can diffuse into the alloy. Also, during solution heat treatment, low melting phases such as magnesium silicide ($Mg_2Si$) near the surface can result in localized melting, providing additional sites for hydrogen diffusion. As a solution, it was determined that controlling the temperature of the slug between about 470° C. to 490° C. (about 880° F. to 920° F.) during forging eliminated blistering caused by micro-cracks due to the high level of silicon in the alloy. In addition, it was determined that reducing the temperature and duration of the solution heat treatment performed after forging eliminated blistering caused by localized melting. While a T4 solution heat treatment of the AA 4032 alloy is generally performed at a temperature of about 510° C. (about 950° F.) for a duration of four hours, a solution heat treatment at about 475° C. to 485° C. (about 885° F. to about 905° F.) for a duration of about two hours was found to eliminate localized melting at the surface, which in combination with the reduced forging temperature eliminated the occurrence of blistering in the alloy of this invention.

Finally, because solutioning of the alloying constituents is reduced at the lower solution heat treatment temperature employed by this invention, the relatively high copper level noted above is employed to promote the ability of the alloying constituents to enter into solid solution. Advantageously, the higher copper level in the alloy of this invention also serves to yield more copper-aluminide ($CuAl_2$) hardening phase, which provides a strengthening mechanism for the aluminum alloy.

The preferred iron content within the aluminum alloy of this invention may vary up to about 0.7 percent iron, with higher iron levels being avoided in order to promote the ductility of the alloy, which is typically impaired by the presence of iron due to the formation of aluminum-magnesium-silicon-iron compounds. In addition, the alloy may contain manganese, zinc, chromium and titanium up to those levels indicated in Table I, though these alloying constituents are not required to attain the desired properties for the piston portrayed in the Figure. Finally, it is important to note that nickel is considered an impurity of the alloy, not exceeding 0.15 weight percent of the alloy, in contrast to the 0.5 to 1.3 weight percent range required by the AA 4032 alloy.

The above alloying approach yields an aluminum alloy that is sufficiently ductile to permit forging of components that also exhibit sufficient strength to permit their use in physically demanding applications, such as the air conditioning compressor piston shown in the Figure. As indicated above, processing of the alloy to form forged components must be adapted to the unique chemical composition of the wear-resistant aluminum alloy of this invention. Processing generally entails the steps of casting a homogeneous melt of the alloy in any suitable manner to form a slug. As discussed above, the slug is preferably preheated to a temperature of about 470° C. to about 490° C. for a period of about forty minutes, after which the slug is forged with a die at a temperature of about 100° C. to about 140° C. (about 250° F.). After trimming, a hot alkaline rinse is performed at about 26° C. to about 34° C. (about 85° F.) for about twenty seconds, followed by the prescribed solution heat treatment (475° C. to 485° C. for two hours) during which a solid solution of copper-aluminide is formed. Artificial aging at about 170° C. to about 180° C. (about 350° F.) for a duration of about nine hours is then preferably performed to precipitate the copper-aluminide throughout the alloy, and thereby acquire the desired mechanical properties of the alloy. This aging step differs from that performed with aluminum-silicon alloys such as AA 4032, which is typically the same aging temperature but for a duration of about ten hours, as a result of the higher copper content in the alloy of this invention promoting precipitation of the desirable copper-aluminide phase. Although this heat treatment schedule resulted in the alloy having the desired properties for the compressor piston shown in the Figure, it is foreseeable that the temperatures and durations used could be modified slightly to obtain a component suitable for other applications, and various equipment, tooling and quenching mediums could be used with satisfactory results.

From the above, it can be seen that the wear-resistant alloy of this invention can be readily processed to form a high-strength, wear-resistant component. Both the processing and composition of the alloy are specifically tailored for compatibility, to yield a wear-resistant aluminum alloy whose mechanical properties include sufficient ductility to enable forging of a compressor piston from the alloy at acceptable temperatures and pressures, sufficient strength to enable the piston to pressurize a refrigerant during operation of an air conditioning compressor, and enhanced wear resistance in the environment of the compressor due to the hardness and high strength of the alloy.

While the invention has been described in terms of a preferred embodiment, it is apparent that other forms could be adopted by one skilled in the art, such as by modifying the aluminum alloy within the preferred ranges of element concentrations, or by modifying the processing steps, or by employing the alloy in an alternative environment. Accordingly, the scope of our invention is to be limited only by the following claims.

The embodiments of the invention in which an exclusive property or privilege is claimed are defined as follows:

1. A wear-resistant aluminum alloy capable of being forged to produce a piston for a compressor of an automotive air conditioning unit, the wear-resistant aluminum alloy consisting of the following by weight:

about 13.0 to about 15.5 percent silicon;

about 0.8 to about 1.8 percent copper;

about 0.8 to about 1.3 percent magnesium;

not more than 0.7 percent iron;

not more than 0.25 percent zinc;

not more than 0.2 percent manganese;

not more than 0.15 percent nickel;

not more than 0.1 percent chromium;

not more than 0.1 percent titanium;

up to about 0.15 percent phosphorus;

not more than 0.15 percent impurities, each of the impurities not exceeding 0.05 percent of the alloy; and the balance being aluminum;

wherein the wear-resistant aluminum alloy contains a dispersion of copper-aluminide precipitates throughout and further contains silicon particles within a range of about fifteen to thirty-five micrometers in equivalent diameter.

2. A wear-resistant aluminum alloy as recited in claim 1 containing about 14.75 to about 15.25 weight percent silicon.

3. A wear-resistant aluminum alloy as recited in claim 1 containing about 1.3 to about 1.8 weight percent copper.

4. A wear-resistant aluminum alloy as recited in claim 1 containing phosphorus in an amount sufficient to yield the silicon particles within a range of about fifteen to thirty-five micrometers in equivalent diameter.

5. A piston forged from the wear-resistant aluminum alloy recited in claim 1.

6. A forging formed of a wear-resistant aluminum alloy consisting of the following by weight:

13.0 to 15.5 percent silicon;

0.8 to 1.8 percent copper;

0.8 to 1.3 percent magnesium;

not more than 0.7 percent iron;

not more than 0.25 percent zinc;

not more than 0.2 percent manganese;

not more than 0.15 percent nickel;

not more than 0.1 percent chromium;

not more than 0.1 percent titanium;

phosphorus in an amount sufficient to yield silicon particles within a range of about fifteen to thirty-five micrometers in equivalent diameter;

not more than 0.15 percent impurities, each of the impurities not exceeding 0.05 percent of the alloy; and the balance being aluminum;

wherein the wear-resistant aluminum alloy contains a dispersion of copper-aluminide precipitates throughout.

7. A wear-resistant aluminum alloy as recited in claim 6 containing 14.75 to 15.25 weight percent silicon.

8. A wear-resistant aluminum alloy as recited in claim 6 containing about 15 weight percent silicon.

9. A wear-resistant aluminum alloy as recited in claim 6 containing 1.3 to 1.8 weight percent copper.

10. A wear-resistant aluminum alloy as recited in claim 6 containing about 1.5 weight percent copper.

11. A wear-resistant aluminum alloy as recited in claim 6 containing 0.9 to 1.2 weight percent magnesium.

12. A piston forged from the wear-resistant aluminum alloy recited in claim 6.

13. A piston produced by a process comprising the steps of:

casting a homogeneous melt of a wear-resistant aluminum alloy consisting of the following by weight: about 13.0 to about 15.5 percent silicon; about 0.8 to about 1.8 percent copper; about 0.8 to about 1.3 percent magnesium; not more than 0.7 percent iron; not more than 0.25 percent zinc; not more than 0.2 percent manganese; not more than 0.15 percent nickel; not more than 0.1 percent chromium; not more than 0.1 percent titanium; up to about 0.15 percent phosphorus; not more than 0.15 percent impurities, each of the impurities not exceeding 0.05 percent of the alloy; and the balance being aluminum;

forging the wear-resistant aluminum alloy to form a piston; and solution heat treating the piston at a temperature of about 475° C. to about 485° C. for a duration of about two hours, during which a dispersion of copper-aluminide precipitates is formed throughout the piston, the piston further containing silicon particles within a range of about fifteen to thirty-five micrometers in equivalent diameter.

* * * * *